United States Patent [19]

Venäläinen

[11] Patent Number: 4,905,496

[45] Date of Patent: Mar. 6, 1990

[54] PROCEDURE IN CAR BODY RECTIFYING WORK AND RECTIFYING MEANS ARRANGEMENT

[75] Inventor: Olavi Venäläinen, Kuopio, Finland

[73] Assignee: Autorobot Finland KY, Finland

[21] Appl. No.: 138,455

[22] PCT Filed: May 27, 1987

[86] PCT No.: PCT/FI87/00072

§ 371 Date: Dec. 29, 1987

§ 102(e) Date: Dec. 29, 1987

[87] PCT Pub. No.: WO87/07190

PCT Pub. Date: Dec. 3, 1987

[30] Foreign Application Priority Data

May 28, 1986 [FI] Finland ..... 862264

[51] Int. Cl.[4] ..... B21D 1/12

[52] U.S. Cl. ..... 72/457; 72/705

[58] Field of Search ..... 254/2 B, 2 C, 10 B, 254/10 C; 187/8.54, 8.71, 8.77; 72/705, 457

[56] References Cited

U.S. PATENT DOCUMENTS

| | | | |
|---|---|---|---|
| 1,938,446 | 12/1933 | Bacher | 254/89 |
| 1,991,255 | 2/1933 | Martin | 254/126 |
| 3,048,237 | 8/1962 | Rutherford | 187/8.43 |
| 3,844,421 | 10/1974 | Nielsen | 187/8.71 |
| 4,219,186 | 8/1980 | Brewer | 254/9 C |
| 4,694,674 | 9/1987 | Lawrence | 72/705 |

FOREIGN PATENT DOCUMENTS

| | | | |
|---|---|---|---|
| 1190917 | 7/1985 | Canada . | |
| 1184479 | 12/1964 | Fed. Rep. of Germany . | |
| 53930 | 5/1978 | Finland . | |
| 2021194 | 7/1970 | France . | |
| 2503065 | 10/1982 | France . | |
| 149834 | 3/1984 | Norway . | |
| 414127 | 7/1980 | Sweden . | |
| 1361170 | 7/1974 | United Kingdom | 72/705 |
| 2136369 | 9/1984 | United Kingdom . | |

*Primary Examiner*—Lowell A. Larson

*Attorney, Agent, or Firm*—Steinberg & Raskin

[57] ABSTRACT

The invention relates to a procedure in car body rectifying work. In the procedure the vehicle is driven onto the rectifying table (11) of the car body rectifying unit (10) and affixed to skirt attachments (12) provided on the rectifying table. The vehicle is raised, while it is on the rectifying table, with the lifting unit (16) of the vehicle rectifying unit to desired height for the rectifying work. Hereafter the lifting unit (16) is removed from under the vehicle and out of functional connection with the rectifying table (11) and the vehicle is left resting on supporting legs (30) connected with the rectifying table (11). The invention also relates to apparatus conforming to the procedure.

19 Claims, 3 Drawing Sheets

PROCEDURE IN CAR BODY RECTIFYING WORK AND RECTIFYING MEANS ARRANGEMENT

BACKGROUND OF THE INVENTION

The object of the present invention is a procedure in car body rectifying work, in said procedure the vehicle being driven onto the rectifying table of the car body rectifying means and fixed with skirt attachments provided on the rectifying table.

The invention also relates to a rectifying means arrangement, said arrangement comprising at least one rectifying table with skirt attachments for fixing the vehicle or equivalent on the rectifying table for the rectifying work.

In rectifying means of the prior art, the lifting means raising the rectifying table is fixedly disposed in relation to the rectifying table. Said lifting unit has not in existing problem solutions been arranged to be such that it could be detached and moved to be immediately used elsewhere.

SUMMARY OF THE INVENTION

The aim of the invention is a car body rectifying means which is appropriate to be employed in simultaneous rectification of several cars or equivalent which have to be rectified. The aim of the invention is an apparatus design which affords a high rectifying work capacity, yet with low apparatus costs.

The aims of the invention are achieved with a procedure and an apparatus design as taught by the invention.

The procedure of the invention is characterized in that the vehicle is lifted, while it is on the rectifying table, with the lifting means of the vehicle rectifying means to desired height for the rectifying work;

the lifting means is removed from under the vehicle and from functional connection with the rectifying table and the vehicle is left to be carried by supporting legs connected to the rectifying table.

The other characteristic features of the procedure of the invention are stated below.

The apparatus design of the invention is mainly characterized in that the apparatus arrangement comprises lifting means functionally connected to the rectifying table and which can be moved under the rectifying table and out from there, and said means further comprising supporting legs which connect with the rectifying table, and when the lifting means has been moved away from under the rectifying table the rectifying table being arranged to rest on said supporting legs.

The other characteristic features of the apparatus of the invention are stated below.

In the procedure of the invention the vehicle is driven onto the rectifying table of the car body rectifying means and attached to the skirt attachments on the rectifying table. While the vehicle is on the rectifying table, it is lifted with the lifting means of the car body rectifying means to a given, desired height for the rectifying work. Thereafter the lifting means are taken away from under the vehicle and out of functional connection with the rectifying table. The vehicle is left on the rectifying table, carried by the supporting legs of the rectifying table. As taught by the invention, the supporting legs are separately detachable and attachable to the rectifying table. The rectifying means arrangement of the invention comprises at least one rectifying table provided with skirt attachments for fixing the vehicle or equivalent to the rectifying table for rectifying work.

The apparatus arrangement comprises lifting means functionally connected with the rectifying table and which can be moved in under the rectifying table and away from there, said apparatus further comprising supporting legs connected with the rectifying table, when the lifting means has been moved away from under the rectifying table the rectifying table being disposable to rest on the supporting legs. As taught by the invention, the length of the supporting legs is adjustable and, likewise, the position in the breadth dimension of the supporting legs can be adjusted with reference to the rectifying table. The supporting leg may be telescopically extendable to desired length. Of course, such a design is also conceivable in which supporting legs of different lengths are used for different lifting heights.

By the procedure and the apparatus design of the invention, major capital savings are achieved since one single lifting unit can be used in a workshop to serve several rectifying tables. The rectifying table itself, and the supporting leg design, is advantageous. The most expensive piece of equipment is the lifting means, but in the problem solution of the present invention the investment of one lifting meabs can be utilized in several rectifying objects at one time.

BRIEF DESCRIPTION OF THE DRAWINGS

The invention is described in detail in the following by referring to certain advantageous embodiments of the invention, presented in the figures of the appended drawings, but to which the invention is not meant to be exclusively confined.

DESCRIPTION OF THE PREFERRED EMBODIMENTS

Figure 1:
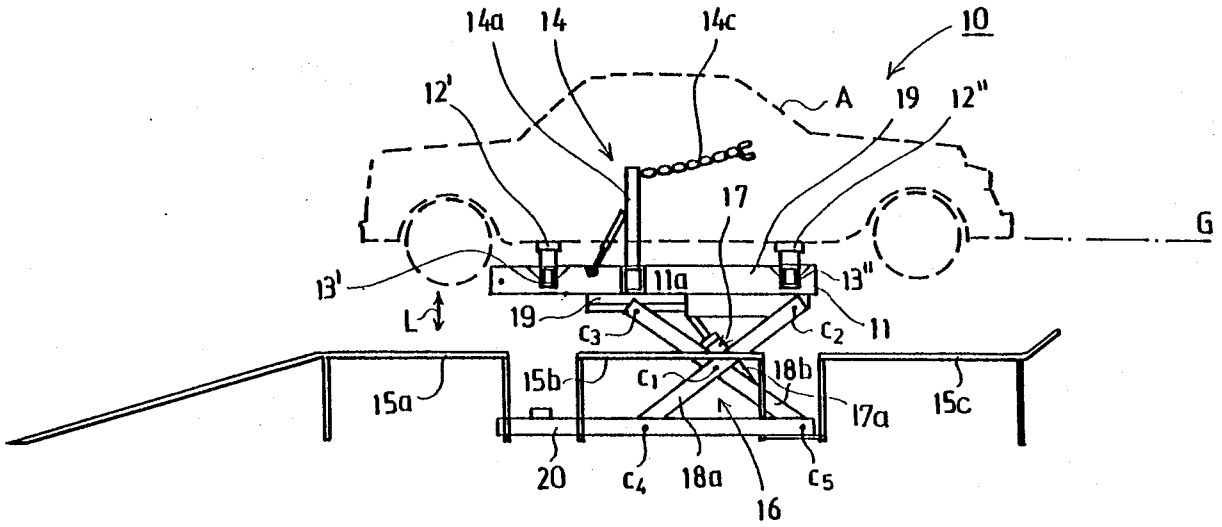
FIG. 1 illustrates an apparatus according to the invention in one rectifying position. The figure is an elevational view, and the car or equivalent object has been placed on the rectifying table and is shown with dotted lines.

In FIG. 1, the object to be rectified, that is a car A, has been driven up onto the rectifying table 11 of the retifying means 10 and is held fast by the skirt attachments 12',12'',12''' and 12''''. The skirt attachments are most advantageously disposed on beams 13',13'',13''' and 13'''' projecting from its frame 11*a*, and they have been disposed to be movable on said beams 13 in accordance with the width of the car in each case. The rectifying means further comprises rectifying heads 14, which are here understood to be components, advantageously beam-like components, producing a rectifying force or mediating a rectifying force and which have been arranged over a provided rectifying jib 14*a* and/or pull halfters 14*c* of equivalent to pull or push at the points where rectification is desired. Said rectifying heads 14 have advantageously been disposed to be located and to attach to the rectifying table 11, to its frame 11*a* and they may be disposed to be movable on telescopic beams of said frame 11.

The car body rectifying means 10 of the invention further comprises driving plates 15, of which there are three in the embodiment of the figure: 15*a*,15*b* and 15*c*, on either side of the rectifying means on its longitudinal axis. The driving plates 15*b* and 15*c* are disposed to be located on the same level, yet so that the beam 13 of the lifting table gas been disposed in its lowermost position to pass through a gap that has been left between the driving plates 15*a* and 15*b*. Similarly there are gaps in the driving plates 15 for the other beams 13, or said drivings have been disposed to be mutually separated in order to form said gap and a passage for the beam 13. As shown in FIG. 1, there is such a space also between the driving plates 15*a* and 15*b*. The rectifying means of the invention furthermore comprises lifting means 16. The lifting means advantageously comprises a lifting cylinder 17, 17*a* which most advantageously is a hydraulic cylinder. Said lifting means 16 has been arranged to raise and lower the vehicle A on the rectifying table 11, i.e., the lifting means 16 has been arranged to raise and lower the rectifying table 11.

According to an advantageous embodiment of the invention, the lifting means 16 is advantageously a shearlegs lifting mechanism. The lifting cylinder 17, 17*a* has been connected between the horizontal upper beam 19 of the lifting means 16 and the frame beam 20 down below in such manner that it is by one end, for instance by the cylinder body 17, connected to the lowermost horizontal beam and to the beam portion 20 closest to the ground and by its other end and by the piston rod end it has been connected to the horizontal frame beam located above. To the horizontal beam 20 are further connected arms 18*a* and 18*b*. The arm 18*a* is by one end attached to the beam 20 and by its other end to the beam 19 and, similarly, the arm 18*b* is by one end attached to the beam 20 and by its other end to the beam 19. The arms 18*a* and 18*b* are pivoted to be turnable in relation to each other, at their centre, by the pivot $C_1$. Said junctures are pivot junctures and they enable the arms 18 to be disposed to be turnable in relation to the beams 19 and 20 at their pivot points $C_2$,$C_3$,$C_4$ and $C_5$. In order for the mechanism to be able to operate, the lower end of one arm and the upper end of the other arm have also been disposed to be movable in horizontal direction.

The lifting means 16 has thus been disposed to raise and lower the vehicle A in the direction of arrow L. As taught by the invention, the lifting means 16 has been disposed to be movable out from under the rectifying table 11 and back in under the rectifying table 11. When the lifting means 16 is being moved away from conjunction with the rectifying table 11 by removing a locking pin 40 or equivalent, the driving plates 15 are removed and, next supporting legs 30 are applied to the rectifying table 11. There are advantageously four supporting legs 30: 30',30'',30''' and 30''''. As taught by the invention, the lifting means 16 may therefore be used in conjunction with several rectifying tables 11, and this can be done when the rectifying tables 11 are fitted with separate supporting legs 30. This problem solution of the invention renders possible the rectifying work done in one shop on several objects to be rectified and using only one lifting means 16. Said lifting means 16 can thus be adapted to serve several rectifying tables 11.

The legs 30 of the rectifying table 11 are most advantageously arranged to be adjustable in length and/or adjustable as to their position in breadth and in such manner that the legs can be fitted in desired supporting positions relative to the rectifying table 11, and thus wide enough apart in the breadth direction.

Figure 2A:
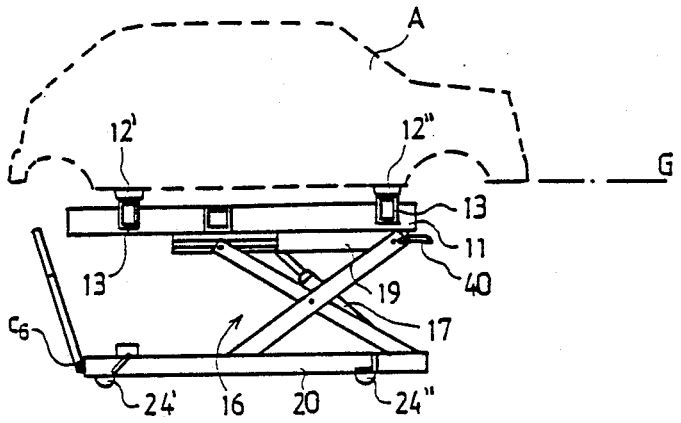
In FIGS. 2A–2C the rectifying apparatus and procedure of the invention are illustrated in the different steps.
Figure 2B:
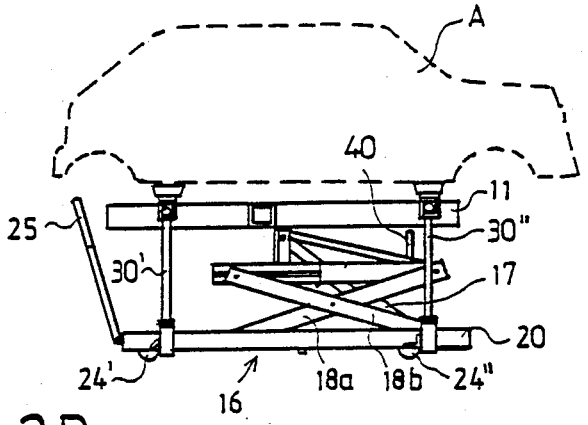
Figure 2C:
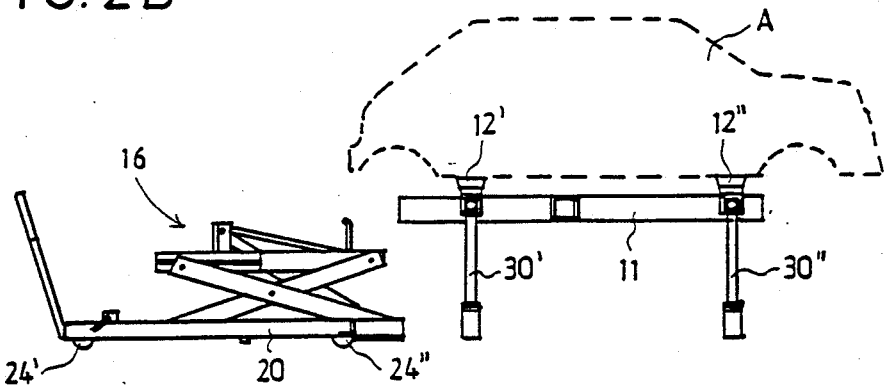

In FIGS. 2A–2C is presented, step by step, the rectifying procedure of the invention and the use of the apparatus of the invention. In FIG. 2A is shown the vehicle A, lifted to desired rectifying position. The supporting legs 30 have not yet been fastened to the rectifying table 11.

In FIG. 2B is depicted the step in which the supporting legs 30, advantageously four supporting legs, have been fastened to the rectifying table 11. The pin 40 is removed or shifted to a position in which it allows the lifting means 16 to be detached from the rectifying table 11 and to be moved away, advantageously by pulling on the rod 25. The beam 20 is provided with wheels 24 or equivalent means which facilitate the removal of the lifting unit 16 from under the rectifying table 11. There are advantageously four wheels 24',24'',24''' and 24''''. The rod 25, or bar, has been disposed to be pivotally attached to the beam 20 by the pivot $C_6$.

Subsequent to the step illustrated in FIG. 2B, the lifting unit 16 may be moved away from under the vehicle and the rectifying work may continue, with the vehicle now fixed by the skirt attachment 12 of the rectifying table 11 and resting on the supporting legs 30.

On the procedure of the invention, which is well illustrated by FIGS. 2A–2C, the vehicle is first driven up onto the rectifying table 11. In the next step the rectifying table 11 is raised with the aid of the lifting means 16 so that the skirt attachments 12 come into contact with the vehicle A. The skirt attachments are then clamped on, advantageously by screw action, so that the vehicle A is held fast on the rectifying table 11. The vehicle A is thereafter raised to desired rectifying height, or to the rectifying level, which has been indicated with G in FIGS. 1 and 2A. When the desired rectifying level G has been reached, the legs 30, advantageously four legs 30',30'',30''' and 30'''', are placed in contact with the rectifying table 11. The supporting legs 30 are secured in desired supporting position to the rectifying table 11. Thereafter the pin 40, or equivalent locking members, is removed and, as shown in FIG. 2C, the lifting unit 16 is moved away from under the rectifying table 11. After this moving, the lifting unit 16 is conveyed to the site of rectification of a new vehicle A to be rectified and into a new position under a new rectifying table 11'.

It becomes possible in this way with the apparatus and procedure of the invention to lift and raise several vehicles in one shop with the aid of one lifting unit 16. Only one lifting unit or lifting means 16 is required, and for each rectifying station in the shop there is separately its own rectifying table 11 provided wiht supporting legs 30. The savings of capital are thus remarkable.

Figure 3:
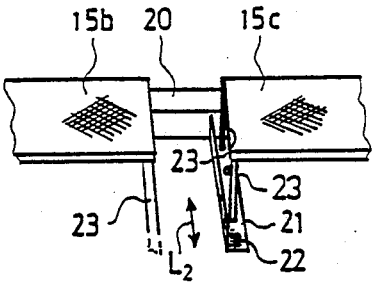
FIG. 3 illustrates an advantageous way of attaching the driving plates to the frame of the lifting unit. The figure is an axonometric projection.

In FIG. 3 is depicted the attaching of the driving plates 15*b* and 15*c* to the supporting legs 21 of the lifting unit 16. After the vehicle has been lifted on the rectifying table 11 to desired rectifying height, the driving plates 15 may be detached and moved away so that they will not interfere with the rectifying work. In the invention this has been arranged to take place in that the driving plates 15 have been disposed to be detachable from and attachable to the supporting legs 21 attached to the lifting unit 16. The supporting legs 21 have receiving recesses or holes 22 into which the driving plates 15 can be fitted by their supporting legs 23 and by the ends thereof. The supporting legs 21 of the lifting unit 16 have been provided with a plurality of receiving recesses 22 for the driving plates 15. Therefore the supporting legs 23 or equivalent of the driving plates 15 can be fitted in different receiving recesses, in accordance with the desired breadth.

The supporting legs 21 may advantageously be L section bars, in which case the bottom of the L section has been disposed to abut on the ground, with the largest possible contact area in order to achieve large supporting breadth and stable support. The supporting legs may be, as shown in FIG. 3, movable in the direction of arrow $L_2$ telescopically within the beam 20, whereby when the lifting unit 16 is being moved away from under the rectifying table 11 the supporting legs 21 may be moved from their spread position so as not to interfere with the transport.

In the embodiment of FIG. 3 has been shown one supporting leg 21. There may be several supporting legs 21, and they have in this embodiment of FIG. 3 been disposed to join fixedly on the lowermost horizontal beam 20 of the lifting means 16, and they have been so disposed that they rest with their lowermost surface against the ground, supporting the lifting of the rectifying table and of the vehicle. There are advantageously four legs 21, but their number may equally be smaller or larger.

Figure 4:
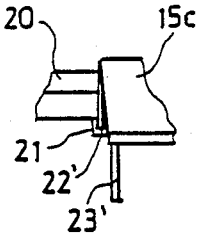
FIG. 4 illustrates another advantageous embodiment of the driving plate attachment.

In FIG. 4 is presented another embodiment of the supporting leg 21. In this embodiment the supporting leg 21 only comprises one receiving recess 22', one supporting leg 23' of the driving plate 15c being disposed to enter said receiving recess 22' and the adjacent supporting leg 23' being disposed merely to rest on the ground. In this embodiment, too, the supporting leg 21 of the lifting unit 16 has been disposed to connect directly with the beam 20, advantageously with its lowermost side face portion.

Figure 5:
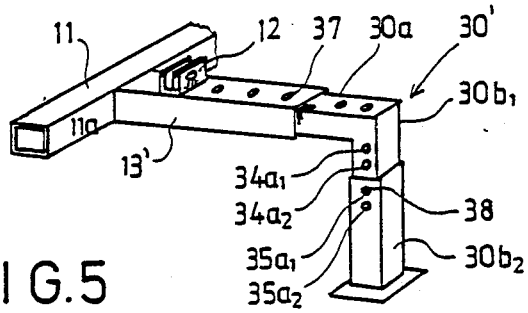
FIG. 5 illustrates, in an axonometric and partial projection, an advantageous embodiment of the supporting leg.

In FIG. 5 is presented an advantageous embodiment of the invention. In the figure is only depicted the connection of one supporting leg 30 of the rectifying table 11 to the rectifying table 11, to its frame **11*a*. The embodiment is advantageously the same also in the case of the other supporting legs 30. In FIG. 5 is shown the supporting leg 30'. The supporting leg 30 advantageously comprises a horizontal beam portion 30*a* and a beam portion 30*b* connected therewith and serving as a vertical leg. The beam section 30*a* has been disposed to be movable in relation to the frame of the rectifying table 11, advantageously in such manner that it is movable relative to the frame 11*a* of the rectifying table 11 within a beam 13' connected with the frame 11*a*. On the beam 13' projecting from the lifting table 11, on the top face, are located movable skirt attachments 12. The leg 30 is horizontally displaceable to assume different positions in the breadth direction relative to the lifting table 11, and advantageously relative to its frame beam 11*a***.

Said moving most advantageously takes place in that the beam portion **30*a* has been disposed to be attachable by means of fixing elements 37 or equivalent in various breadth positions. In the embodiment of FIG. 5, the beam 13' has receiving recesses, and correspondingly the beam 30 has corresponding recesses on its horizontal portion 30*a*. A cotter pin 37, or another equivalent quick fixing means, can be passed through these receiving recesses, whereby the leg 30' is held exactly in horizontal position relative to the frame 11*a***.

As taught by the invention, the leg 30 is disposed to be adjustable in length. Therefore in the vertical portion **30*b* of the leg 30' have been provided telescopic sections $30b_1$ and $30b_2$, these being disposed to be movable in relation to each other, in such manner that one part or the other has been arranged to be movable and slidable in relation to the other part into different fixing positions. Advantageously, the beam portion $30b_1$ has been disposed to be movable within the beam portion $30b_2$, in such manner that the beam portion $30b_1$ has receiving recesses $34a_1$,$34a_2$,$34a_3$,etc. and similarly the beam portion $30b_2$ has receiving recesses $35a_1$,$35a_2$, etc. The pin 38 or equivalent quick fixing element can be passed through these receiving recesses, whereby the leg 30' will be locked in a given length position. In FIG. 5 has only been shown one mode of attaching the leg 30 of the invention to the rectifying table 11. There may be a plurality of telescopic sections, or the leg 30** may have fixed length.

Figure 6:
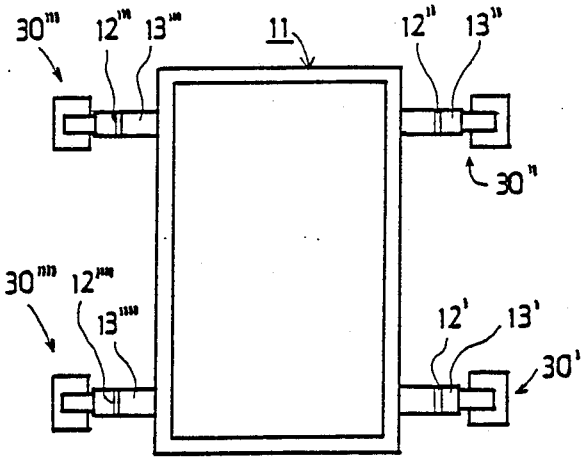
FIG. 6 illustrates the rectifying table in top view, the rectifying table being carried by the supporting legs.

In FIG. 6 is presented the apparatus of the invention viewed from above, with the supporting legs attached to the rectifying table 11.

I claim:

1. Apparatus for supporting an object so that it can be rectified, comprising a plurality of separate rectifying tables, a single lifting arrangement which is engagable with each said rectifying table, and is movable underneath each said table and out from under each said table, each said rectifying table additionally comprising supporting legs which are movable to a position supporting said table when said lifting arrangement has been moved out from thereunder, cantilever beams forming part of each said rectifying table, and disposed to be couplable to said supporting legs, at least three driving plates arranged to allow said cantilever beams to be situated in gaps therebetween in a lowest position of said rectifying table, said driving plates being coupled to said lifting arrangement to be removable when said rectifying table has been lifted to an appropriate repair height, so that said driving plates do not disturb repair work.

2. The combination of claim 1, wherein each said rectifying table additionally comprises skirt attachments thereon for fixing the object to the same.

3. The combination of claim 2, wherein said skirt attachments are movably disposed on said cantilever beams.

4. The combination of claim 1, wherein said legs are formed and disposed to be attachable to and detachable from each said rectifying table.

5. The combination of claim 4, wherein said supporting legs are such adjustable in height.

6. The combination of claim 5, wherein said supporting legs are each additionally adjustable in a substantially perpendicular direction to the height thereof, towards and away from each said rectifying table.

7. The combination of claim 6, wherein said legs are each fixable in a number of discrete positions towards and away from each said rectifying table, and additionally comprising implements for fixing said legs in said discrete positions.

8. The combination of claim 6, wherein each said leg comprises three telescoping sections, two of said telescoping sections coupled to one another such that said leg is adjustable in height, and two of said telescoping sections coupled with one another such that said legs is adjustable in said substantially perpendicular direction to the height.

9. The combination of claim 8, wherein each said leg comprises an inner telescoping section substantially in the shape of an L, and to outer telescoping sections, each adapted to be coupled to said inner section such that said leg is adjustable in both said directions.

10. The combination of claim 5, wherein said legs are each fixable in a number of discrete height positions, and additionally comprising fixing elements for fixing said legs in said discrete positions.

11. The combination of claim 1, wherein said legs each comprise two telescoping parts, with one of said telescoping parts arranged to telescopically move with respect to a respective coupled cantilever beam.

12. The combination of claim 1, additionally comprising at least one fixing element mounted upon said lifting arrangement for detachably coupling or locking said lifting arrangement to said rectifying table.

13. The combination of claim 12, wherein said fixing element is a pin.

14. The combination of claim 1, wherein said lifting arrangement comprises rotatable supporting means for supporting the same to be movable both underneath and out from under said rectifying tables.

15. The combination of claim 14, wherein said supporting means comprise rollers or wheels.

16. The combination of claim 1, additionally comprising means for rectifying the objects situated upon said table after said table is supported by said legs and said lifting arrangement has been moved out from thereunder, said rectifying means being mounted upon said rectifying table.

17. The combination of claim 16, wherein said rectifying means comprise a rectifying head mounted upon said rectifying table, in turn comprising a rectifying jib mounted upon said table and a rectifying chain attached to said jib for connection with the object to be rectified, so that appropriate force can be exerted upon the object.

18. The combination of claim 1, wherein said lifting arrangement comprises supporting legs having receiving recesses or holes, and each said driving plate comprises supporting legs for fitting into said recesses or holes of said lifting arrangement supporting legs.

19. The combination of claim 1, wherein said lifting arrangement comprises an upper beam for supporting each said rectifying table and an opposite lower beam, a pair of cross arms pivotally connected to one another and pivotally connected to each said beam, and a lifting piston and cylinder connected to said upper and lower beams.

* * * * *